US010648267B2

(12) United States Patent
Hestetun et al.

(10) Patent No.: US 10,648,267 B2
(45) Date of Patent: May 12, 2020

(54) SUBSEA UMBILICAL TERMINATION ASSEMBLY

(71) Applicant: VETCO GRAY SCANDINAVIA AS, Sandvika (NO)

(72) Inventors: Steinar Lindemann Hestetun, Billingstad (NO); Hans-Peter Fleischer, Sandvika (NO)

(73) Assignee: VETCO GRAY SCANDINAVIA AS, Sandvika (NO)

( * ) Notice: Subject to any disclaimer, the term of this patent is extended or adjusted under 35 U.S.C. 154(b) by 0 days.

(21) Appl. No.: 15/544,576

(22) PCT Filed: Jan. 13, 2016

(86) PCT No.: PCT/EP2016/050529
§ 371 (c)(1),
(2) Date: Jul. 19, 2017

(87) PCT Pub. No.: WO2016/116333
PCT Pub. Date: Jul. 28, 2016

(65) Prior Publication Data

US 2017/0350209 A1 Dec. 7, 2017

(30) Foreign Application Priority Data

Jan. 19, 2015 (NO) ..... 20150092

(51) Int. Cl.
*E21B 33/043* (2006.01)
*E21B 47/00* (2012.01)
(Continued)

(52) U.S. Cl.
CPC ..... *E21B 33/043* (2013.01); *E21B 33/0385* (2013.01); *E21B 47/0001* (2013.01); *E21B 47/0007* (2013.01); *H01R 13/523* (2013.01)

(58) Field of Classification Search
CPC ..... E21B 33/043; E21B 33/0385; E21B 47/0001; E21B 47/0007
See application file for complete search history.

(56) References Cited

U.S. PATENT DOCUMENTS 4,117,287 A * 9/1978 Walker ..... E21B 33/0385 200/302.1
8,100,182 B2 * 1/2012 Smith ..... E21B 43/013 166/339
(Continued)

FOREIGN PATENT DOCUMENTS

GB 2 471 091 A 12/2010
GB 2 494 180 A 3/2013
(Continued)

OTHER PUBLICATIONS

Hestetun, S.L., Subsea well template, GE co-pending Application No. 20151480, filed on Oct. 29, 2015.
(Continued)

*Primary Examiner* — Matthew R Buck
*Assistant Examiner* — Aaron L Lembo
(74) *Attorney, Agent, or Firm* — Baker Hughes Patent Organization

(57) ABSTRACT

A subsea umbilical termination assembly comprising: an umbilical termination head fixed to the end of a subsea umbilical; and an electrical and/or optical distribution unit comprising a base frame and several connectors mounted to the base frame, wherein each connector is electrically connected to an electrical cable of the subsea umbilical via the umbilical termination head or optically connected to an optical cable of the subsea umbilical via the umbilical termination head. The umbilical termination head is mounted in a space provided inside the base frame of the distribution unit.

14 Claims, 5 Drawing Sheets

(51) Int. Cl.
*H01R 13/523* (2006.01)
*E21B 33/038* (2006.01)

(56) References Cited

U.S. PATENT DOCUMENTS

| | | | |
|---|---|---|---|
| 2014/0046599 | A1 | 2/2014 | Smith et al. |
| 2014/0103636 | A1 | 4/2014 | Hestetun |

FOREIGN PATENT DOCUMENTS

| | | | | |
|---|---|---|---|---|
| RU | 138764 | U1 | 3/2014 | |
| WO | 2009/145906 | A1 | 12/2009 | |
| WO | WO-2010019290 | A1 * | 2/2010 | ..... F16L 1/26 |
| WO | 2014/206831 | A1 | 12/2014 | |

OTHER PUBLICATIONS

First Office Action and Search issued in connection with corresponding NO Application No. 20150092 dated Aug. 19, 2015.
International Search Report and Written Opinion issued in connection with corresponding PCT Application No. PCT/EP2016/050529 dated Apr. 25, 2016.
International Preliminary Report on Patentability issued in connection with corresponding PCT Application No. PCT/EP2016/050529 dated Jul. 25, 2017.

* cited by examiner

SUBSEA UMBILICAL TERMINATION ASSEMBLY

BACKGROUND OF THE INVENTION

The present invention relates to a subsea umbilical termination assembly.

A subsea installation for processing and transport of oil and gas usually comprises subsea well equipment installed at the seabed and connected to a surface structure, for instance in the form of a surface vessel or platform, by means of a subsea umbilical. The subsea umbilical may be used to supply hydraulic fluid and/or electric power to the subsea well equipment and/or deliver different types of production chemicals and service fluids to the subsea well equipment and/or transmit different types of electrical and/or optical signals between the surface structure and the subsea well equipment. The subsea umbilical may comprise several fluid lines, electrical cables and/or optical cables. The fluid lines and cables of the subsea umbilical are bundled together and enclosed within an outer protective sheathing. At the seabed, the subsea umbilical ends in an umbilical termination head, which is permanently fixed to the end of the subsea umbilical before the subsea umbilical is delivered for installation. During the installation, the subsea umbilical and the umbilical termination head are normally lowered into the sea from a surface vessel with the umbilical termination head connected to an electrical and/or optical distribution unit, which is normally located in line with the umbilical termination head.

SUMMARY OF THE INVENTION

An aspect of an embodiment is to provide a subsea umbilical termination assembly of new and favourable design.

According to an embodiment, this object is achieved by a subsea umbilical termination assembly having the features A subsea umbilical termination assembly comprising: an umbilical termination head fixed to the end of a subsea umbilical; and an electrical and/or optical distribution unit comprising a base frame and several connectors mounted to the base frame, wherein each connector is electrically connected to an electrical cable of the subsea umbilical via the umbilical termination head or optically connected to an optical cable of the subsea umbilical via the umbilical termination head, characterized in that the umbilical termination head is mounted in a space provided inside the base frame of the distribution unit.

The subsea umbilical termination assembly of an embodiment of the present invention comprises: an umbilical termination head fixed to the end of a subsea umbilical; and an electrical and/or optical distribution unit comprising a base frame and several connectors mounted to the base frame, wherein each connector is electrically connected to an electrical cable of the subsea umbilical via the umbilical termination head or optically connected to an optical cable of the subsea umbilical via the umbilical termination head.

According to an embodiment of the invention, the umbilical termination head is mounted in a space provided inside the base frame of the distribution unit. Hereby, the umbilical termination head and the distribution unit may be integrated with each other in a space-saving manner and the length of the subsea umbilical termination assembly may thereby be reduced.

Further advantages as well as advantageous features of the subsea umbilical termination assembly of embodiments of the present invention will appear from the following description and.

BRIEF DESCRIPTION OF THE DRAWINGS

With reference to the appended drawings, a specific description of embodiments of the invention cited as examples follows below. In the drawings.

DETAILED DESCRIPTION

Figure 1:
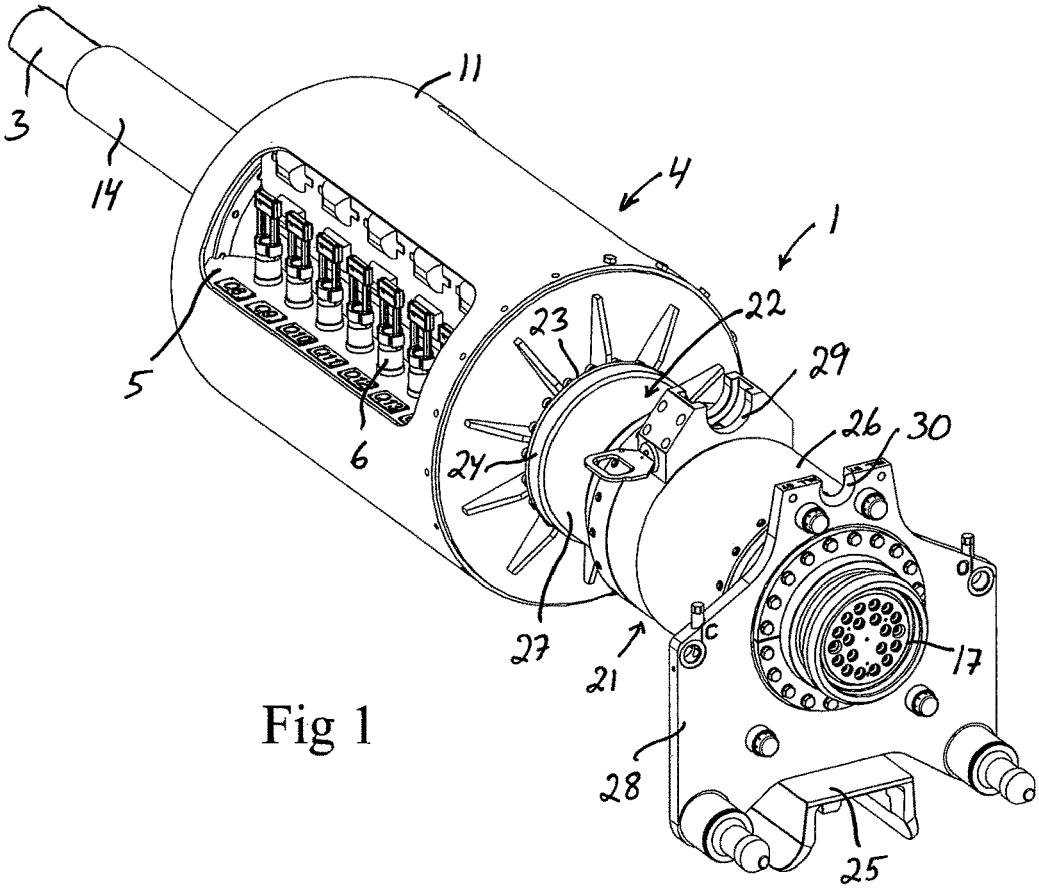
FIG. 1 is a perspective view from a front end of a subsea umbilical termination assembly according to an embodiment.
Figure 2:
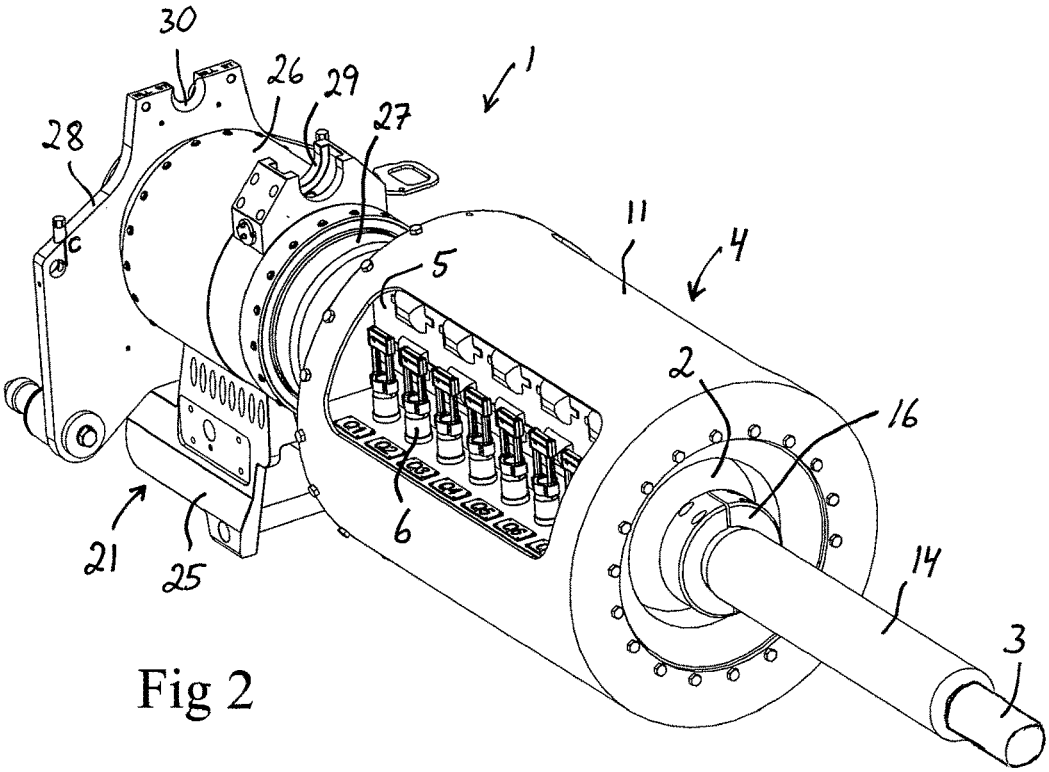
FIG. 2 is a perspective view from a rear end of the subsea umbilical termination assembly of FIG. 1.
Figure 3:
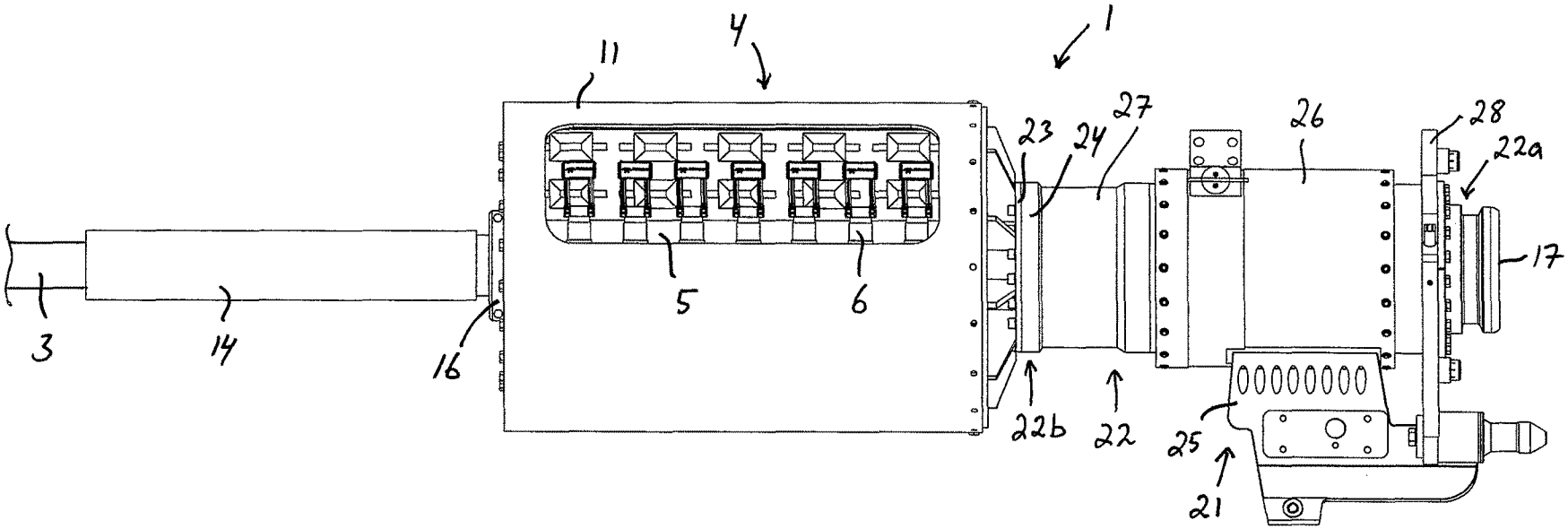
FIG. 3 is a lateral view of the subsea umbilical termination assembly of FIG. 1.
Figure 4:
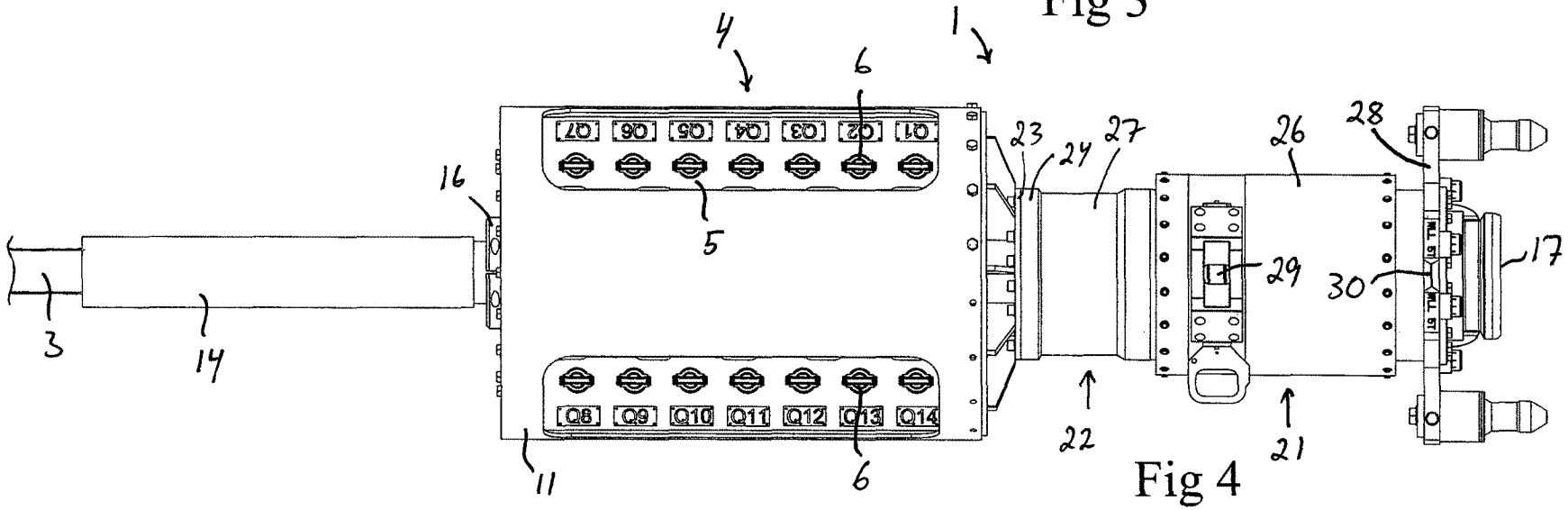
FIG. 4 is a planar view from above of the subsea umbilical termination assembly of FIG. 1.
Figure 5:
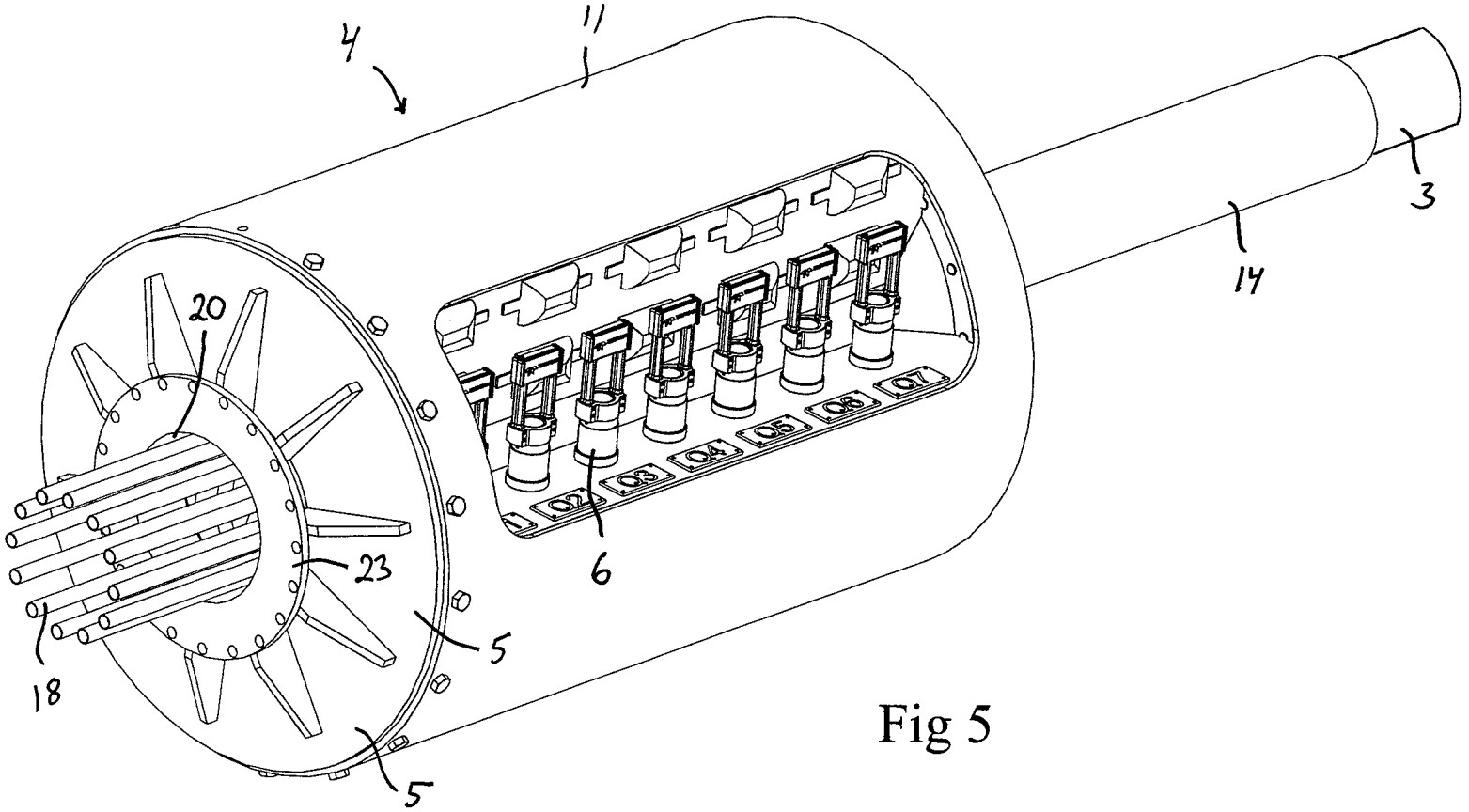
FIG. 5 a perspective view of the rear part of the subsea umbilical termination assembly of FIG. 1.
Figure 6:
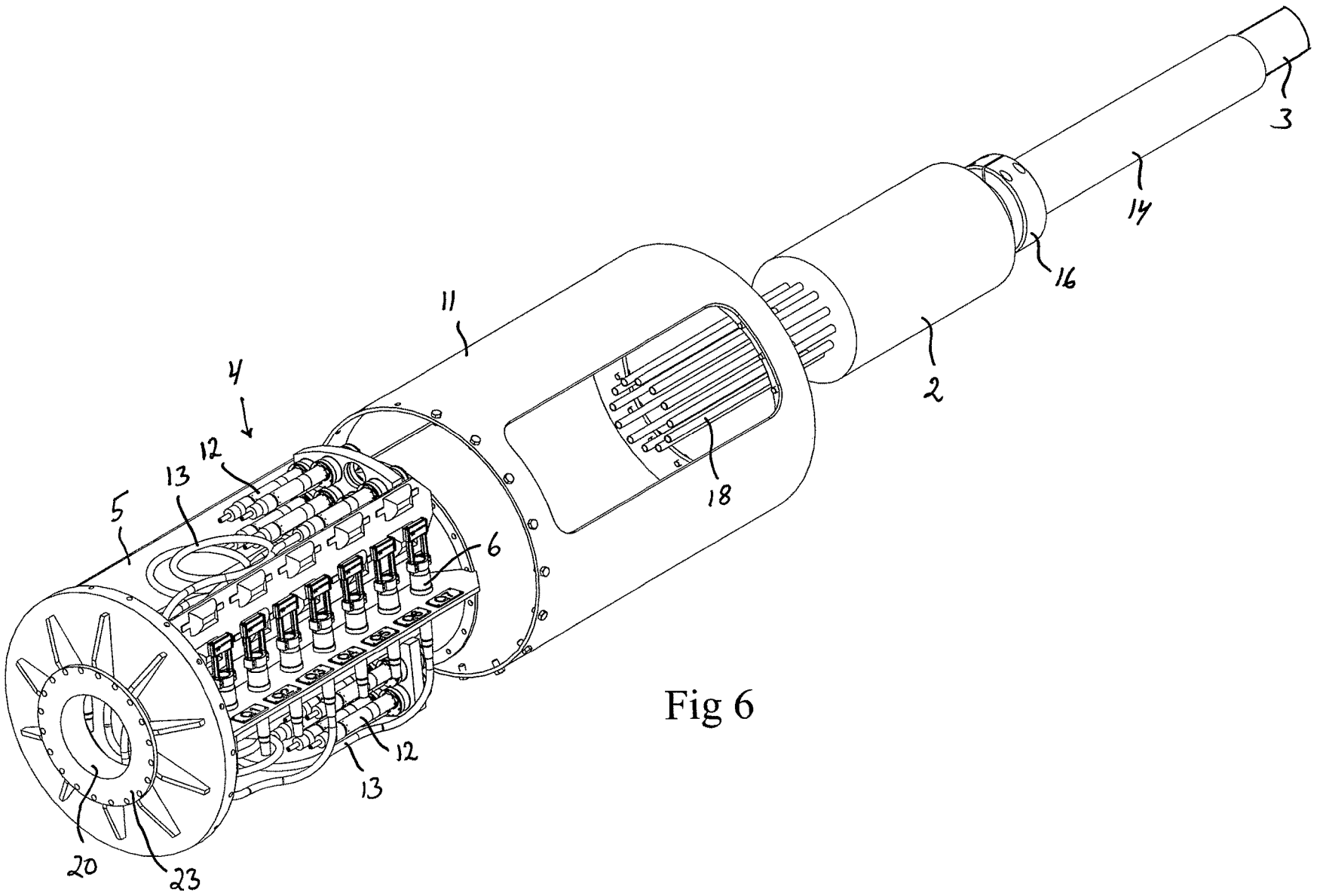
FIG. 6 is an exploded view of the part shown in FIG. 5.
Figure 7:
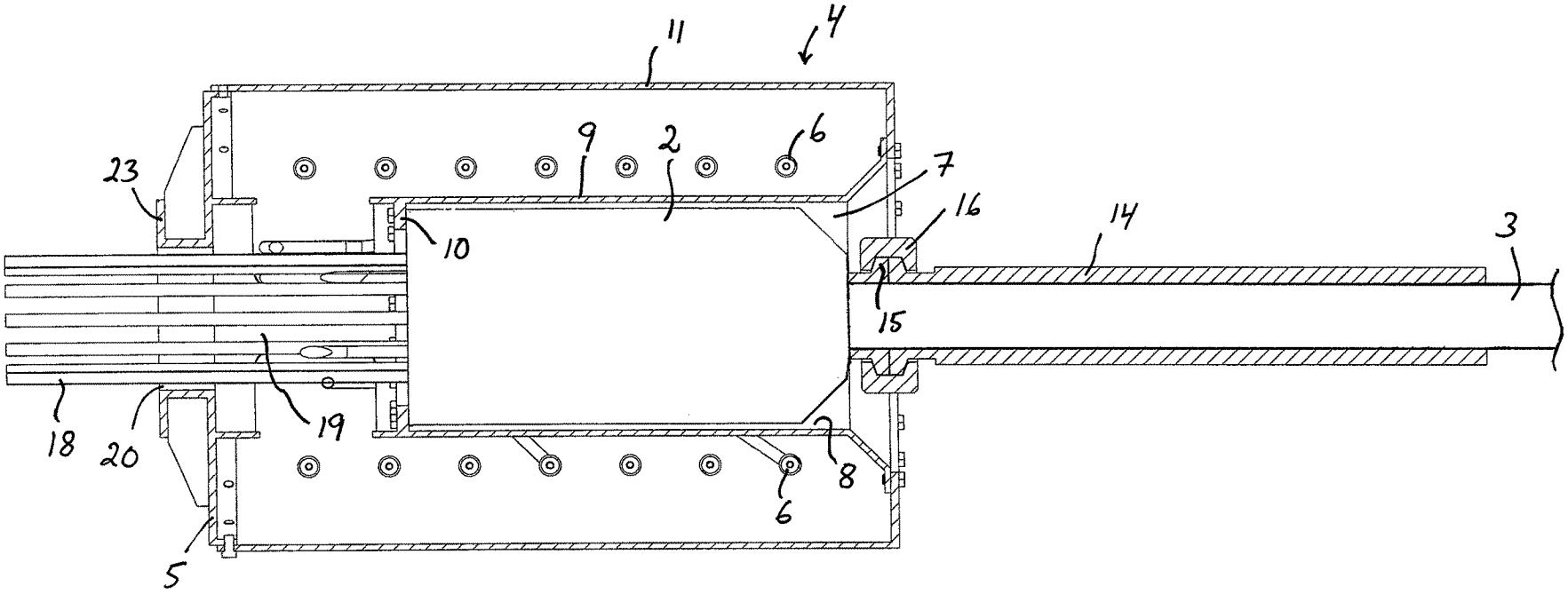
FIG. 7 is a partly cut top view of the part shown in FIG. 5.

A subsea umbilical termination assembly 1 according to an embodiment of the present invention is illustrated in FIGS. 1-7. The subsea umbilical termination assembly 1 comprises an umbilical termination head 2 which is fixed to an end of a subsea umbilical 3. The subsea umbilical 3 comprises several fluid lines (not shown) and electrical and/or optical cables (not shown) which are bundled together inside the umbilical. The bundle of fluid lines and cables is enclosed within an outer protective sheathing.

The fluid lines of the subsea umbilical 3 may be used for supplying hydraulic fluid or delivering different types of production chemicals and service fluids to subsea well equipment. The electrical cables of the subsea umbilical 3 may be used for supplying electric power to subsea well equipment or transmitting electrical signals between a surface structure and subsea well equipment. The optical cables of the subsea umbilical 3 may be used for transmitting optical signals between a surface structure and subsea well equipment.

The subsea umbilical 3 terminates in the umbilical termination head 2, where the fluid lines and cables of the umbilical 3 are separated from each other in a conventional manner.

The subsea umbilical termination assembly 1 also comprises an electrical and/or optical distribution unit 4. The distribution unit 4 comprises a base frame 5 and several electrical and/or optical connectors 6 mounted to the base frame 5. Each electrical connector 6 of the distribution unit 4 is electrically connected to an electrical cable of the subsea umbilical 3 via the umbilical termination head 2 and each optical connector of the distribution unit 4 is optically connected to an optical cable of the subsea umbilical 3 via the umbilical termination head 2. The connectors 6 are in a conventional manner configured for engagement with electrical or optical flying leads (not shown), by means of which the distribution unit 4 is connected to the desired subsea well equipment.

The umbilical termination head 2 is mounted in a space 7 (see FIG. 7) provided inside the base frame 5 of the distribution unit 4. The umbilical termination head 2 is, in an embodiment, centrally positioned inside the base frame 5. In the illustrated embodiment, the umbilical termination head 2 is circularly cylindrical and accommodated in a correspondingly shaped cavity 8 in the base frame 5, wherein the base frame 5 comprises an inner cylindrical wall 9 which delimits said cavity 8 in the radial direction and surrounds the umbilical termination head 2. In the example illustrated in FIG. 7, the umbilical termination head 2 is bolted to an annular flange 10 of the base frame 5 provided at the inner end of the cavity 8. However, the umbilical termination head 2 may of course be fixed to the base frame 5 in any other suitable manner.

The base frame 5 of the distribution unit 4 is surrounded by a cylindrical outer casing 11, which has a circular cross-sectional shape, in an embodiment.

At least some of the connectors 6 are located in a space of the distribution unit 4 radially outwardly of the umbilical termination head 2. In the illustrated embodiment, the distribution unit 4 comprises several electrical terminations 12 (see FIG. 6) mounted to the base frame 5, wherein each electrical termination 12 is electrically connected to an electrical cable of the subsea umbilical 3 via the umbilical termination head 2 and to one of said connectors 6. The electrical terminations 12 are located in a space of the distribution unit 4 radially outwardly of the umbilical termination head 2, in an embodiment. For the sake of clarity, some of the electrical cables 13 between the umbilical termination head 2 and the electrical terminations 12 and between the electrical terminations 12 and the connectors 6 are omitted in FIG. 6.

An end section of the subsea umbilical 3 may be surrounded by a bend restricting element 14 which extends along the end section and is fixed to a flange 15 (see FIG. 7) at the rear end of the umbilical termination head 2, for instance by means of a clamping device 16. The bend restricting element 14 is configured to reduce the flexibility of the end section of the subsea umbilical 3.

The subsea umbilical termination assembly 1 comprises a multibore hub 17 and several fluid conduits 18 extending between the umbilical termination head 2 and the multibore hub 17, wherein each fluid conduit 18 is in fluid communication with a fluid line of the subsea umbilical 3. The fluid conduits 18 extend through an axial passage 19 (see FIG. 7) in the base frame 5 of the distribution unit 4 and through an opening 20 at the front end of the base frame 5.

In the illustrated embodiment, the subsea umbilical termination assembly 1 also comprises a base structure 21 and a sliding unit 22 slidably mounted to the base structure 21. The base frame 5 of the distribution unit 4 is fixed to the sliding unit 22 at the rear end 22*b* thereof. In the illustrated example, the base frame 5 is provided with an annular mounting flange 23 at its front end, and this mounting flange 23 is bolted to a corresponding flange 24 at the rear end 22*b* of the sliding unit 22 to thereby secure the base frame 5 to the sliding unit 22. The above-mentioned fluid conduits 18 extend axially through the sliding unit 22.

The multibore hub 17 is fixed to the sliding unit 22 at the front end 22*a* thereof so as to be axially moveable in relation to the base structure 21 together with the sliding unit 22. The multibore hub 17 is configured for engagement with a corresponding hub (not shown) of a subsea appliance.

The subsea umbilical termination assembly 1 also comprises an actuating unit (not shown), which is configured to act between the base structure 21 and the sliding unit 22 and by means of which the sliding unit 22 can be pushed axially forwards in relation to the base structure 21.

In the illustrated embodiment, the base structure 21 of the subsea umbilical termination assembly 1 comprises a lower base frame 25 and a support sleeve 26 mounted to the base frame 25, whereas the sliding unit 22 comprises a tubular body 27 and a vertical holding plate 28 rigidly mounted to the tubular body 27 at the front end thereof. The tubular body 27 is displaceably received in said support sleeve 26. The tubular body 27 extends through the support sleeve 26 and is axially displaceable in relation to the support sleeve 26 by means of the above-mentioned actuating unit.

The above-mentioned actuating unit may comprises a stroking device in the form of a hydraulic cylinder (not shown) configured to act between the support sleeve 26 and the tubular body 27 in the manner illustrated in US 2014/0103636 A1, the content of which being incorporated herein by reference. The hydraulic cylinder comprises a cylinder part, a piston displaceably received inside the cylinder part and a piston rod fixed to the piston. The base structure 21 comprises a first holder 29 to which the cylinder part is attachable, whereas the sliding unit 22 comprises a second holder 30 to which the piston rod is attachable. In the illustrated example, the first holder 29 is mounted to the support sleeve 26, whereas the second holder 30 forms part of the holding plate 28 provided at the front end of the tubular body 27.

The base structure 21 of the subsea umbilical termination assembly 1 is connectable to a landing platform (not shown) of a subsea support structure by being lowered downwards onto said landing platform so as to come to bear against it. The base structure 21 of the subsea umbilical termination assembly 1 is provided with guiding means configured to co-operate with corresponding guiding means on the subsea support structure so as to guide the base structure 21 into a correct position in relation to the landing platform of the subsea support structure when the subsea umbilical termination assembly 1 is lowered downwards into contact with the landing platform. These guiding means may for instance be of the types disclosed in closer detail in US 2014/0103636 A1. The subsea umbilical termination assembly 1 is intended to be lowered into the sea, e.g. from a surface vessel, barge or platform, while hanging in a crane hook of a hoisting device through lifting wires (not shown) attached to the subsea umbilical termination assembly 1.

The invention is of course not in any way restricted to the embodiments described above. On the contrary, many possibilities to modifications thereof will be apparent to a person with ordinary skill in the art without departing from the basic idea of the invention such as defined in the appended claims.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A subsea umbilical termination assembly comprising:

an umbilical termination head fixed to the end of a subsea umbilical having a plurality of electrical and/or optical cables;

a cylindrical outer casing; and a distribution unit comprising:

a base frame defining a longitudinal axis, the base frame comprising an inner cylindrical wall radially spaced away from the longitudinal axis, an inner cylindrical cavity delimited radially by the inner cylindrical wall, at least two walls extending outward from, and circumferentially spaced relative to, the inner cylindrical wall, and a plurality of connectors mounted to at least one of the at least two walls of the base frame, each connector configured to be electrically connected to an electrical cable of the subsea umbilical via the umbilical termination head or optically connected to an optical cable of the subsea umbilical via the umbilical termination head, wherein the umbilical termination head is mounted in the inner cylindrical cavity of the base frame of the distribution unit and the cylindrical outer casing is mounted over the distribution unit, such that the umbilical termination head, the distribution unit and the cylindrical outer casing are all coaxial relative to each other and to the longitudinal axis of the base frame.

2. The subsea umbilical termination assembly according to claim 1, wherein the outer casing is cylindrical.

3. The subsea umbilical termination assembly according to claim 2, wherein the umbilical termination head has a circular cross-sectional shape.

4. The subsea umbilical termination assembly according to claim 1, wherein the umbilical termination head is centrally positioned inside the base frame of the distribution unit.

5. The subsea umbilical termination assembly according to claim 1, wherein the plurality of connectors is located in the outer annular space in the outer casing of the distribution unit radially outwardly from the umbilical termination head.

6. The subsea umbilical termination assembly according to claim 1, wherein the distribution unit further comprises a plurality of electrical terminations mounted to a surface of the base frame that is perpendicular to the at least two walls of the base frame, wherein each electrical termination is electrically connected to an electrical cable of the subsea umbilical via the umbilical termination head and to one of the connectors.

7. The subsea umbilical termination assembly according to claim 6, wherein the plurality of electrical terminations is located within an outer annular space between the cylindrical outer casing and the inner cylindrical wall of the base frame.

8. The subsea umbilical termination assembly according to claim 1, further includes a multibore hub and a plurality of fluid conduits extending from the umbilical termination head extending to the multibore hub, wherein each fluid conduit is in fluid communication with a fluid line of the subsea umbilical.

9. The subsea umbilical termination assembly according to claim 8, wherein the plurality of fluid conduits extends through an axial passage in the base frame disposed with the outer casing of the distribution unit to the multibore hub.

10. The subsea umbilical termination assembly according to claim 8, further comprising:

a base structure and a sliding unit slidably mounted to the base structure, the sliding unit having a front end and an opposite rear end;

the base frame of the distribution unit is fixed to the sliding unit at the rear end thereof and the multibore hub is fixed to the sliding unit at the front end thereof; and the plurality of fluid conduits extends axially through the sliding unit.

11. The subsea umbilical termination assembly according to claim 1, wherein the umbilical termination head is disposed coaxially with the outer casing.

12. The subsea umbilical termination assembly according to claim 1, wherein umbilical termination head is attached by at least one fastener to the distribution unit.

13. The subsea umbilical termination assembly according to claim 12, wherein the base frame includes an annular flange whereby the umbilical termination head is attached by the at least one fastener.

14. The subsea umbilical termination assembly according to claim 1, wherein the plurality of connectors is configured to engage with flying leads of subsea well equipment.

* * * * *